US005624320A

United States Patent [19]

Martinez

[11] Patent Number: 5,624,320

[45] Date of Patent: Apr. 29, 1997

[54] FLOWER PRESENTATION DEVICE

[76] Inventor: Benjimin P. Martinez, 190 W. Patterson, Ogden, Utah 84401

[21] Appl. No.: 613,666

[22] Filed: Mar. 11, 1996

[51] Int. Cl.[6] ..... A63H 37/00

[52] U.S. Cl. ..... 472/51; 472/56; 446/310; 446/361; 206/423; 206/804

[58] Field of Search ..... 472/51, 52, 54, 472/137, 56; 446/310, 361, 475; 206/423, 804

[56] References Cited

U.S. PATENT DOCUMENTS 968,057 8/1910 Iwata ..... 446/310 X 1,443,770 1/1923 Tourtas ..... 446/361

1,455,653 5/1923 Palmer ..... 446/310

3,376,666 4/1968 Leonard ..... 206/423

*Primary Examiner*—Kien T. Nguyen

*Attorney, Agent, or Firm*—A. Ray Osburn

[57] ABSTRACT

A person-to-person flower presentation package, wherein a bundle of flowers is placed out of sight in a preferably conical, open-topped, container. Upon presentation, a cord is pulled, raising the blossoms suddenly into view. The package also includes one or more popping sound generators which are actuated as the flower-raising cord is pulled.

17 Claims, 4 Drawing Sheets

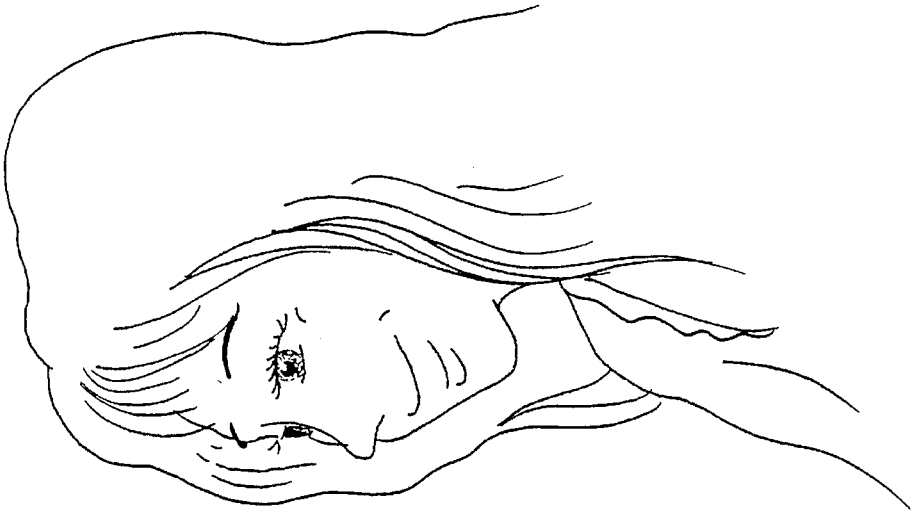
FIG. 1
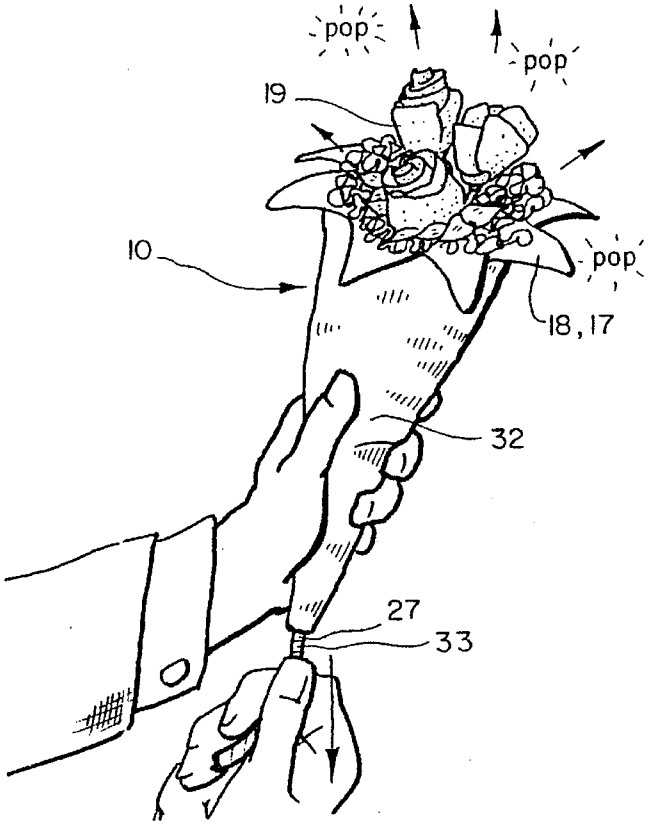

FLOWER PRESENTATION DEVICE

BACKGROUND OF THE INVENTION

1. Field

The field of the invention is packaging apparatus for presentation of flowers from one person to another.

2. State of the Art

Gifts of flowers carry their own very effective, even if mute, language conveying respect, admiration, congratulations and the like to the recipient, who can seldom fail to feel the underlying sentiment, even in the absence any accompanying verbal message. Flowers are given in honor of births, marriages, birthdays, holidays and many other current memorable events, and even memorable past triumphs and milestones in the lives of the recipients. Some situations are best commemorated by quiet respectful bestowal of the floral offerings. In other situations, there is strong motivation to call attention not only to the flowers but to the flower giver as an individual. This is often true when the recipient is the object of the giver's personal affections.

However, prior art packaging of roses or other flowers for presentation in the latter situations is largely free of variety or dramatic impact, perhaps because floral tributes themselves tend to be considered ultimate emotional expressions. There is substantial merit in this viewpoint. However, floral tributes are so widespread as to become prosaic, and boringly predictable. In the familiar scenario, the admiring swain, for example, clutches a clump of long stemmed flowers, generally roses and generally red, in his outstretched hand, unpackaged or at best partially wrapped in paper or transparent plastic. For surprise, many presenters attempt to conceal the flowers in a hand held behind the back, to then be flourished into the face of the recipient. Reliance is of necessity upon dramatic words, demeanor and gestures unaided by packaging. It is to be expected that the presenter will need all the help he can obtain.

Therefore, a need remains for a way of packaging flowers and bouquets that will add drama to the act of presentation from one person to another.

BRIEF SUMMARY OF THE INVENTION

With the foregoing in mind, the present invention eliminates or substantially alleviates the shortcomings in prior art packaging devices for presentation of long stemmed flowers from one person to another. The inventive device comprises an open-topped, preferably conical, generally hollow shell receptacle into which the flowers are placed with stems down, blossoms up, the latter however below the open top out of the sight of the recipient. The receptacle preferably has appropriately colorful exterior wrapping. The flowers are fastened into a single bundle by securing the lowermost ends of the stems together, as by an encircling collar, which may comprise elastic bands, wrappings of adhesive tape or the like. Attached to the collar is one of the ends of a flexible pull cord, by which the bundle of flowers is raised upon presentation to bring the blossoms upwardly into the view of the recipient person. Pull cord guides allow the presenter to raise the bundle by pulling down the other end, which is outside the receptacle. These guides preferably comprise a pair of perforations through the shell, through which the cord slips, at least one of which is substantially above the initial elevation of the stem collar. The pull cord exits through this perforation and then re-enters via the remaining one. After re-entering, the pull cord finally exits the receptacle through another perforation, preferably at the lowermost end of the receptacle body, such as the tip of a conical body. At this point, the pull cord emerging end is grasped and pulled downward to raise the flower bundle as described above.

Preferably, the flower presentation device further comprises one or more of a state of the art device commonly called a "party popper" secured to the interior surface of the shell wall of the receptacle. A triggering lanyard cord emerges downwardly from each popper to extend to and through the perforation at the bottom of the receptacle. The lanyard cords are then preferably secured together with the bundle pull cord below and outside the receptacle, to be pulled downwardly therewith.

When the flowers are presented, the giver pulls downwardly upon the together-secured cords, the hoisting pull cord propelling the flowers upwardly and out of the upper opening suddenly before the eyes of the recipient, while the party poppers are actuated to pop sharply. Confetti may be stored coiled within the poppers, to be expelled upwardly, uncoiling and mixing into an illusion of froth as the blooms are raised.

It is therefore the principal object of the invention to provide a method of packaging gift flowers for dramatic and entertaining presentation from one person to another.

BRIEF DESCRIPTION OF THE DRAWINGS

In the drawings, which represent the best modes presently contemplated for carrying out the invention, FIG. 1 illustrates the flowers being presented from one person to another, being raised upwardly into view of the recipient to the accompaniment of popping sounds, drawn to a reduced scale, FIG. 2 a side elevation view of the inventive package of FIG. 1, drawn to approximately the same scale, showing decorative external wrapping of the body, along with an inwardly curling uppermost fringe initially shielding the blossoms from view, FIG. 3 a cross sectional view of the presentation device of FIG. 2, drawn to the same scale, FIG. 4 a cross sectional view of the presentation device of FIG. 1, and the bundle of flowers shown in its raised position hoisted upwardly by the pull cord, drawn to the scale of FIG. 2, FIG. 5 a view of the presentation package of FIG. 1, with the decorative cover however removed, and the conical receptacle body being split along a slope line and spread apart to show the interior contents of the package, drawn to the approximate scale of FIG. 2, FIG. 6 a side elevation view of one of the popping sound generators which are enclosed within the presentation package, drawn to a somewhat enlarged scale, FIG. 7 a vertical cross sectional view of the popping sound generator of FIG. 6, drawn to the scale thereof, and FIG. 8 a top plan view of the presentation package of FIG. 2, drawn to approximately the scale thereof.

DETAILED DESCRIPTION OF ILLUSTRATED EMBODIMENTS

Figure 4:
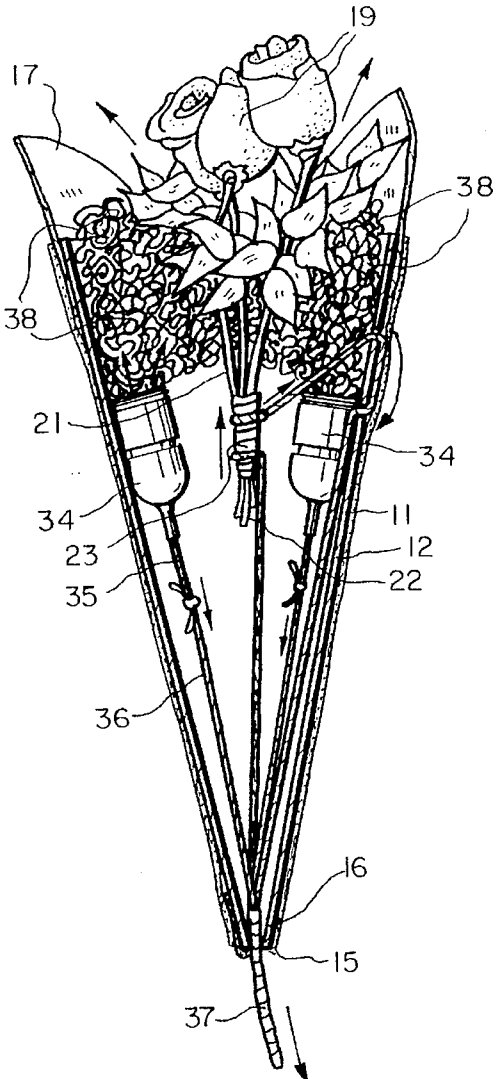
Figure 3:
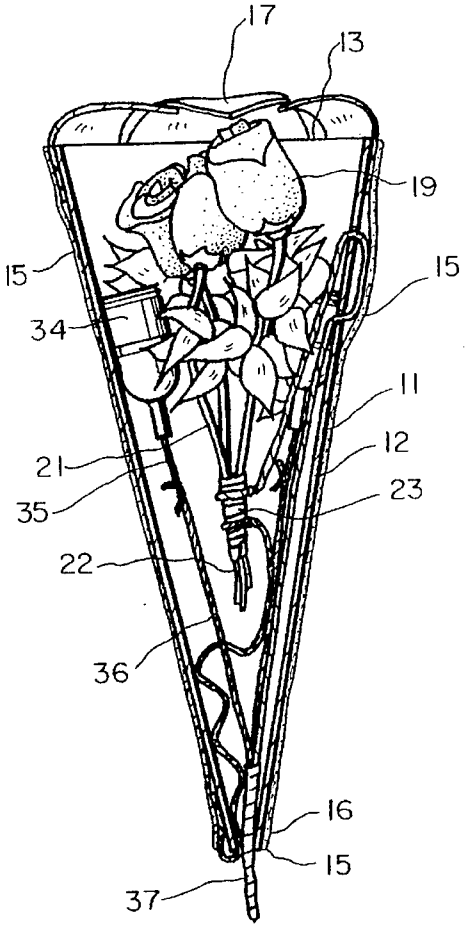
Figure 2:
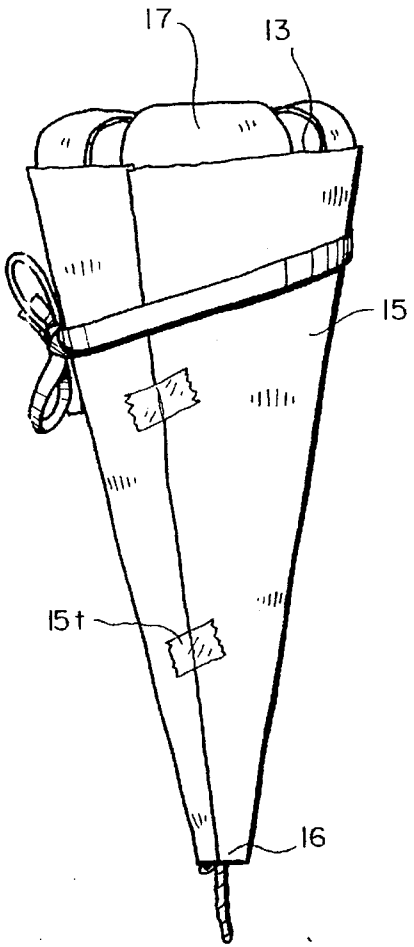
Figure 5:
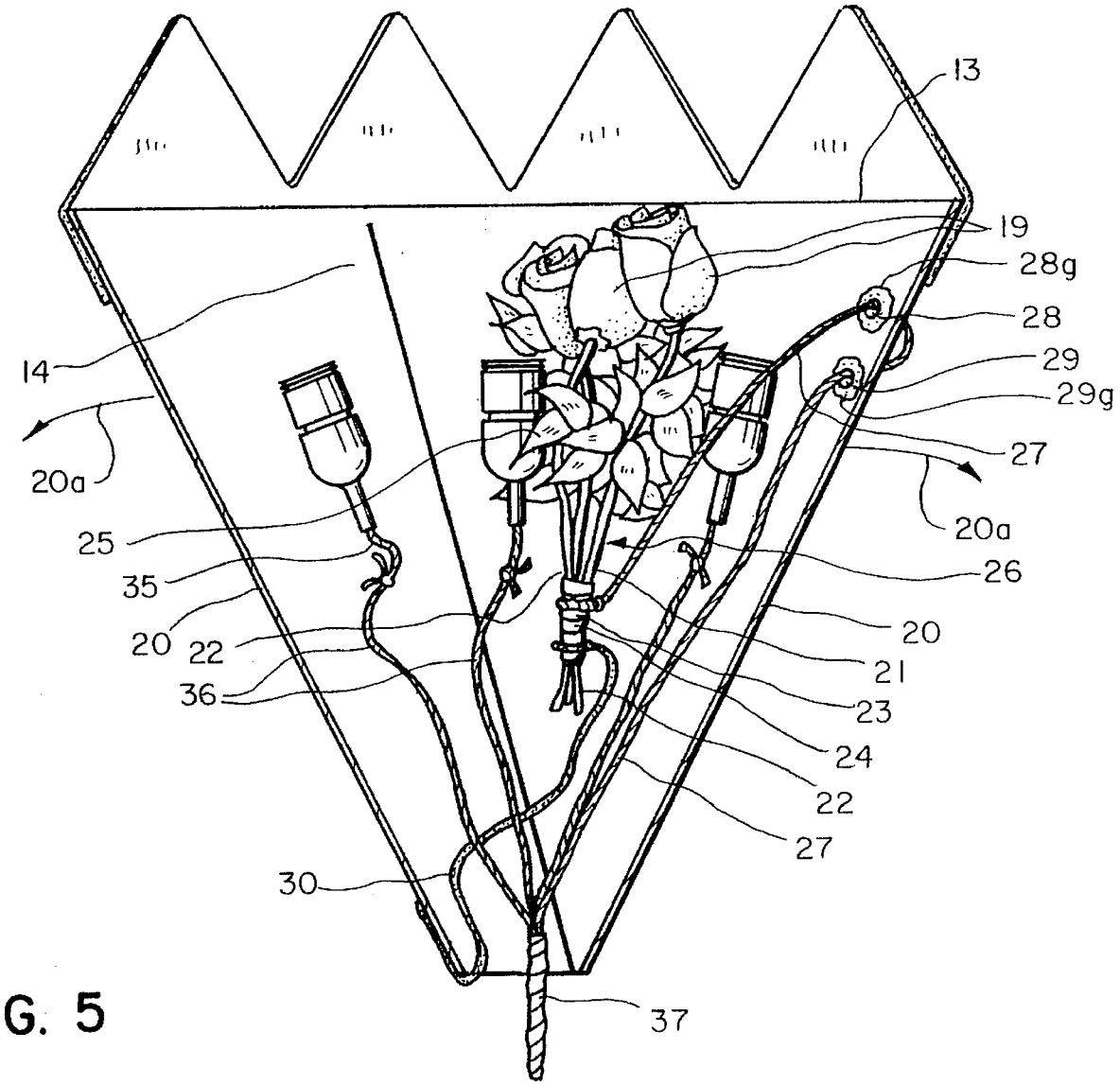

The inventive flower presentation device 10 illustrated in conjunction with flowers for presentation from one person to another. The device is preferably conical in exterior shape, suggestive of familiar flower packages. (FIGS. 1–4) Hollow body 11 comprises a thin paperboard or plastic sheet 12 curled into a cone with an open top 13. Overlapping sheet edge portion 14 is secured to sheet 12 as by bonding material, not shown. (FIG. 5) A small open aperture 15 is provided at cone tip 16. Attractive wrapping paper 15 secured by tape swatches 15t covers body 11. Preferably, a paper fringe 17 is secured about open top 13, having inwardly curled projections 18 substantially masking the tops of blossoms 19 from view. In FIG. 5, body 11 is shown severed along a cone slope line 20 and pulled to spread apart as indicated by arrows 20*a* to more clearly reveal internal contents. Downwardly extending stems 21 of blossoms 19 are secured together at stem lower ends 22 by an encircling retaining collar 23. In the illustrated embodiment, collar 23 comprises multiple windings 24 of adhesive tape tieing blossoms 19, leaves 25 and stems 21 together into a single bundle 26, with the blossoms below open top 13. A flexible bundle hoisting pull cord 27 is tied firmly about collar 23, from which it extends upwardly to exit from body 11 through the upper one 28 of a pair of vertically aligned perforations 28 and 29 through sheet 12. Pull cord 27 then re-enters body 11 by way of the lower perforation 29 to then extend downwardly to and through tip aperture 15. Circumferential bands 28*g* and 29*g*, of hardened glue for example, may be provided to strengthen the sheet 12 at the perforations.

A bundle anchoring cord 30 is securely tied to collar 23 and extends downwardly to and through the aperture 15, to then be secured as by adhesive tape, not shown, to the outside of the conical body 11 under wrapping 15. Anchoring cord 30 is installed with sufficient slack to allow bundle 26 to be hoisted by pull cord 27 only high enough for the blossoms 19 and the leaves 25 emerge upwardly through open top 13.

Thus the device 10 may be used to dramatically present flowers from one person to another. (FIG. 1) Lower portion 32 of conical body 11 is grasped in one hand, and the lower end 33 of hoisting cord 27 is pulled by the other hand downwardly to slip through perforations 28 and 29 to lift flower bundle 26. Flexible fringe leaves 18 are pushed outwardly by rising blossoms 19, which spring suddenly into the view of the receiving person.

To render the presentation auditorially as well as visually startling, three state of the art devices 34 called "party poppers" are installed within body 11, secured as by cured hardened glue, not shown, to the inside surface of conical body sheet 12. Each popper 34 has a downwardly emerging actuation lanyard cord 35, each extended by flexible cord segment 36 to join with the bundle hoisting pull cord 27 below tip aperture 15 of body 11. These cords are all fastened together as by a wrapping 37 of adhesive tape. When the wrapping 37 is pulled downwardly, the bundled blossoms 19 are propelled upwardly out of conical body 11, and the poppers 34 are actuated to each emit a startling but harmless popping sound. Each popper also spews an upwardly tumbling froth of unwinding confetti 38. (FIG. 4) Thus, the blossoms, leaves and confetti "explode" into view. The timing of the popping sounds may be coordinated with the rise of bouquet bundle 26 by selecting the relative amounts of slack in lanyards 36 and bundle pull cord 27. With more than one popper 34, simultaneous or sequential popping sounds also may be provided in this manner.

Figure 6:
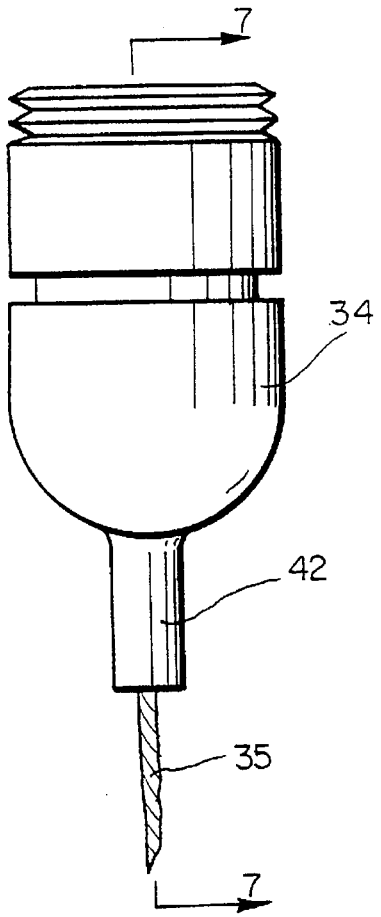
Figure 7:
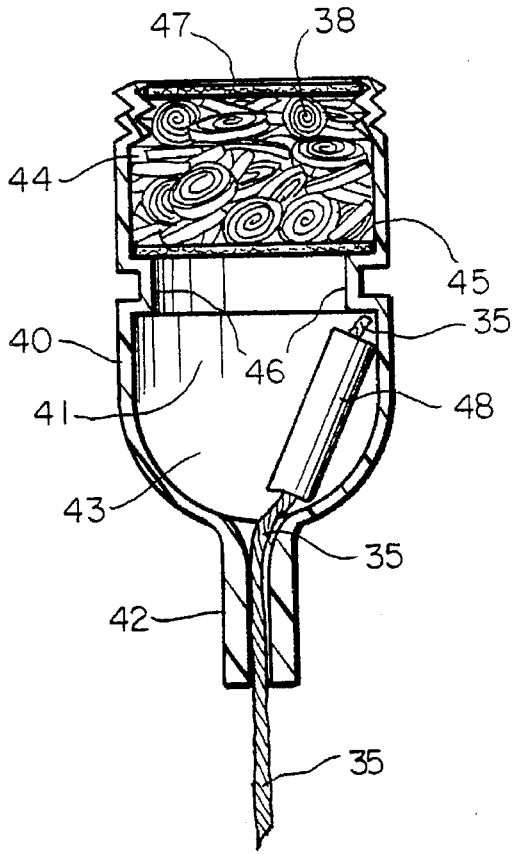
Figure 8:
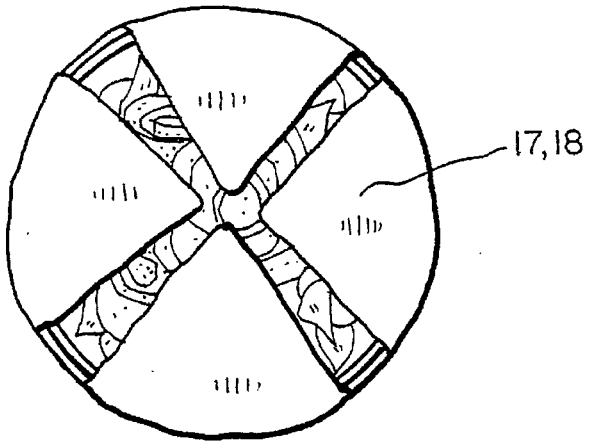

The state of the art poppers 34 are commonly made in China. One example is the K2269 "Party Popper" manufactured in JIANGXI, China. A typical design comprises an external shell body 40 of soft plastic with a sizeable upper chamber 41 and a downwardly extending hollow stem 42. (FIGS. 6 and 7) Chamber 41 has a lower compartment 43 separated from an upper compartment 44 by a thin paper barrier 45 wedged into body 40 above a circumferential projection 46 about the interior of body 40. A similar barrier 47 is wedged into a circumferential groove at the top of compartment 44, which contains multiple coils 38 of colorful confetti. In lower compartment 43 is a small firecracker-like hollow paper cylinder 48 bonded to body 40, containing a tiny quantity of explosive powder, not shown. The powder is ignited by frictional heat when lanyard cord 35 is pulled through cylinder 48, producing a small explosive popping sound. Expanding gases of combustion are substantially confined to lower compartment 43, so that barriers 45 and 47 are blown upwardly out of body 40, along with unwinding coils 38 of confetti, the latter creating the illusion of froth emerging from the top of conical body 11. Other ways of creating the auditory pops might be employed, such as utilization of a percussion cap device within body 11, triggered by a tug on the lanyard cord.

Body 11 is illustrated to be constructed from flat cardboard sheeting 12 by cutting a proper pattern, not illustrated, to be subsequently curled into a cone and secured using the overlapping bonding strip edge 14. Other possible constructions for body 11 include injection molded cones. Other shapes than conical may if desired be selected, such as cylindrical or square.

Although the flower assemblies for presentation are illustrated as each comprising a blossom and an attached long stems, the device may within the spirit of the invention be adapted for presentation of flower assemblies with very short stems or none at all. The device is generally adaptable for presentation of freshly cut live flowers and manufactured substitutes therefor.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Patent is:

1. A person-to-person flower presentation device, comprising:

a hollow body having wall means enclosing a space therewithin, having a substantially open uppermost end; wherein the space within the body encloses a group of at least one flower assembly comprising at least a blossom;

means securing the blossoms together into a single bundle thereof;

a flexible bundle pull string having a pair of opposite ends, one of which is fastened to the blossom securing means; and pull string guide means positioned upon the body so that the bundle of blossoms is raised by pulling upon the other of said pair of ends outside of the hollow body.

2. The person-to-person flower presentation device of claim 1, wherein:

the flower assembly comprises a blossom connected to an uppermost end of a downwardly extending elongate stem member having a lowermost end; and the means securing the blossoms together comprises means securing the lowermost ends of the stem members together, so that the group of flowers comprises a single bundle thereof with the blossoms uppermost thereon.

3. The flower presentation device of claim 2, wherein:

the bundle of flowers is raised by pulling downwardly upon the bundle pull string.

4. The flower presentation device of claim 3, wherein:

the blossoms of the bundle of flowers are generally below the open uppermost end of the body, and are lifted to a position thereabove as the bundle is raised.

5. The flower presentation device of claim 4, wherein:

the pull string guide means comprises a perforation carried by the hollow body wall means at an elevation higher than the stem member securing means, through which the pull string exits from the hollow body.

6. The flower presentation device of claim 5, wherein:

the pull string guide means further comprises;

a guiding perforation carried by the hollow body wall means through which the pull string re-enters the hollow body; and the hollow body wall means carries a perforation through which the pull string finally exits from the hollow body to be pulled from outside thereof to raise the bundle of flowers.

7. The flower presentation device of claim 6, further comprising:

at least one popping sound generator mounted within the hollow body; and means actuating said generator as the bundle of flowers is raised by pulling upon the pull string.

8. The flower presentation device of claim 7, wherein:

the means actuating the popping sound generator comprises a flexible lanyard cord extending from said generator to and through the pull string final exit guiding perforation, said lanyard cord and the pull string being pulled simultaneously.

9. The flower presentation device of claim 8, wherein:

the popping sound generator comprises a hollow body containing an explosive device which produces the popping sound when actuated by the lanyard cord, and a plurality of rolls of confetti, said explosive device generating a pulse of combustion gases expelling the confetti from the body upwardly simultaneously with the elevation of the bundle of flowers.

10. The flower presentation device of claim 8, wherein:

the wall means comprises a shell expanding conically from a lowermost tip portion thereof to the open uppermost top of the hollow body; and the perforation of final exit of the pull string from the hollow body is at said tip portion.

11. The flower presentation device of claim 10, further comprising:

a serrated decorative fringe secured to the body shell at the uppermost open end thereof, extending inwardly thereover to substantially shield the blossoms from view therethrough.

12. The flower presentation device of claim 11, wherein:

the flower assembly is selected from among freshly cut live flower components and manufactured substitutes therefor.

13. The flower presentation device of claim 6, wherein:

the flower assembly is selected from among freshly cut live flower components and manufactured substitutes therefor.

14. The flower presentation device of claim 5, further comprising:

at least one popping sound generator mounted within the hollow body; and means actuating said generator as the bundle of flowers is raised by pulling upon the pull string.

15. The flower presentation device of claim 14, wherein:

the means actuating the popping sound generator comprises a flexible lanyard cord extending from said generator to and through the pull string final exit guiding perforation, said lanyard cord and the pull string being pulled simultaneously.

16. The flower presentation device of claim 3, wherein:

the flower assembly is selected from among freshly cut live flower components and manufactured substitutes therefor.

17. The flower presentation device of claim 1, wherein:

the flower assembly is selected from among freshly cut live flower components and manufactured substitutes therefor.

* * * * *